US006386418B1

(12) United States Patent
Garner

(10) Patent No.: US 6,386,418 B1
(45) Date of Patent: May 14, 2002

(54) PALM STAPLER

(76) Inventor: Nancy T. Garner, 5306 Hatcher Rd., New Bern, NC (US) 28562

( * ) Notice: Subject to any disclaimer, the term of this patent is extended or adjusted under 35 U.S.C. 154(b) by 134 days.

(21) Appl. No.: 09/628,611

(22) Filed: Jul. 31, 2000

(51) Int. Cl.[7] ..... B25C 5/06
(52) U.S. Cl. ..... 227/133; 227/134; 227/156
(58) Field of Search ..... 227/134, 156, 227/133

(56) References Cited

U.S. PATENT DOCUMENTS

| | | | | |
|---|---|---|---|---|
| 2,462,623 A | | 2/1949 | Flamm | |
| 3,987,951 A | * | 10/1976 | Thornhill | 227/156 |
| 4,002,281 A | * | 1/1977 | Hsu | 227/76 |
| 5,183,196 A | | 2/1993 | Miyashita | |
| 5,407,118 A | | 4/1995 | Marks | |
| 5,497,932 A | | 3/1996 | Brewer et al. | |
| 5,690,268 A | | 11/1997 | Evans et al. | |
| 5,779,211 A | * | 7/1998 | Bird | 248/346.01 |
| 5,797,535 A | | 8/1998 | Lovegrove et al. | |
| 5,988,478 A | | 11/1999 | Marks | |
| 5,992,724 A | | 11/1999 | Snyder | |
| 6,152,347 A | * | 11/2000 | Wilson et al. | 227/134 |

* cited by examiner

*Primary Examiner*—Scott A. Smith
(74) *Attorney, Agent, or Firm*—MacCord Mason PLLC

(57) ABSTRACT

Described is a hand-held stapler that can be supported in the palm of a user's hand, so that both of the user's hands are available to position and hold items before and during stapling. The stapler includes an egg-shaped or domed stapler head conforming to and fitting against the user's palm, and a strap to hold the domed surface against the palm while freeing the user's fingers for positioning and holding the item to be stapled. A staple magazine carried on the staple head is moveable from an uncompressed position to a compressed position to discharge a staple when the stapler is pressed against a surface. A support base may be included to support the stapler head and magazine when not in use.

20 Claims, 4 Drawing Sheets

PALM STAPLER

BACKGROUND OF THE INVENTION (1) Field of the Invention

The present invention relates generally to hand-held staplers, and in particular to a hand-held stapler that can be held against the palm of the user's hand, so that the user can use both hands to position items to be stapled without the need to release the stapler.

(2) Description of the Prior Art

Hand-held staplers are well known in the prior art, and are generally comprised of a staple-delivery head that is hinged to a base, which serves to support the stapler on an surface. A staple magazine with side and bottom walls hold a strip of aligned, adjacent staples, and a staple positioner urges the staple strip to one end of the magazine, where a plunger carried by the stapler head forces the leading staple through a slot in the magazine bottom wall when the head is pressed downwardly.

These staplers are designed to insert the points of the staple entirely though the material to be stapled, e.g., a stack of papers, with the ends of the staple being bent after insertion to prevent removal of the staple. Thus, the base includes an anvil positioned beneath the slot to deflect the ends of the staple, either inwardly or outwardly.

These staplers can also be used to drive staples into surfaces without bending the staples by pivoting the base, which is usually held toward the head with a releasable catch, out of the staple pathway.

Staplers of this configuration are exemplifed by the following U.S. patents:

U.S. Pat. No. 2,462,623 Flamm

U.S. Pat. No. 5,183,196 Miyashita

U.S. Pat. No. 5,690,268 Evans et al.

U.S. Pat. No. 5,992,724 Snyder

Other staplers are designed to only drive staples, generally of a heavier design than the staplers used in the above staplers, through a first material and into an underlying surface without bending the ends of the staples. These staplers, often referred to as impact staplers, also include a staple magazine to hold a strip of staples, a staple positioner to urge the staple strip to one end of the magazine, and a plunger to force the leading staple through a slot in the magazine bottom. However, the plunger instead of being attached to the surface pushed downwardly by the user, as is normally the case with the above staplers, is spring-loaded and released by a trigger mechanism to drive the plunger, and thus the trigger with greater force. A base and anvil is not used with this type of stapler, since the points of the staples are not turned.

Staplers of this configuration are exemplifed by the following U.S. patents:

U.S. Pat. No. 5,407,118 Marks

U.S. Pat. No. 5,497,932 Brewer et al.

U.S. Pat. No. 5,988,478 Marks

Either stapler design can be easily used to staple a plurality of articles or items to each other or one or more items to a surface. However, if the items are not first arranged in the manner in which they are to be stapled, the user must discontinue stapling in order to arrange the items. Unless the items can be arranged with one hand, the user must release the stapler in order to use both hands to position the items in the desired arrangement.

In many circumstances, releasing the stapler to free both hands for manipulation of the items to be stapled can significantly increase the time required to staple a plurality of items, especially if the only available surface for placement of the stapler is remote from the area where stapling is being performed. For example, when there is a need to staple a plurality of items or workpieces to a vertical surface, the user must position a first item with one hand while holding the stapler in the other, or place the stapler on a nearby surface until the item is position, and then reach for the stapler once the item is positioned. In either event, the item must be held in place with one hand while being stapled. The complexities of these maneuvers can be even more pronounced if the user is also trying to hold several other items that need to be stapled to the vertical surface.

For instances, many teachers, particularly elementary school teachers are required to staple artwork, posters and other paper items to bulletin boards or to other surfaces on the walls of a class room. Often, the teacher must stand on a stool, or reach above his or her head, to place the items at a desired height. Thus, the teacher must hold several papers and a stapler, position one of the papers while juggling the other papers and the stapler, and then staple the first paper with one hand without letting it slip out of position.

These manipulations, which must be preformed not only by teachers, but by numerous other individuals for a variety of purposes, are at a minimum inconvenient and increase the time required to perform the task. In some instances where the item to be stapled cannot be positioned or held with one hand, the chore can be impossible to perform. Thus, there is a need for a stapler that can be held by the user while still permitting the user to position the item to be stapled.

SUMMARY OF THE INVENTION

The present invention addresses this need by providing a stapler that is held in the palm of the user's hand, while permitting the user to user his or her fingers to manipulate and hold the item to be stapled, even when the item is being stapled.

Generally, the stapler of the invention is comprised of an elongated staple magazine that is supported on the lower surface of a stapler head having an upper surface generally conforming to the shape of a user's palm, and an attachment strap used to hold the upper surface in the palm of the user.

The elongated staple magazine includes a staple housing configured to hold a plurality of adjacent, aligned staples, and a staple positioner to urge the staples toward the forward end of the magazine. The housing is comprised of a pair of spaced side walls separated by a width approximately equal to the width of the staples to be positioned in the magazine, and a lower wall connecting the bottom edges of the side walls. The bottom wall includes a staple discharge slot having a width approximately equal to the thickness of a single staple. The housing also includes an end wall at its forward end to position the leading stapler over the staple discharge slot.

The staple positioner is generally comprised of a contact block to engage the rear end of the aligned staples and a spring to urge the block toward the front of the staple magazine. The positioner can be inserted through the top of the magazine, or though the rear end of the magazine.

The staple magazine is moveably positioned on the lower surface of a uniquely designed cover or head that can be supported in the palm of the user's hand, permitting the stapler to be carried and used, while freeing the user's fingers for other manipulations. Specifically, the stapler head includes a convex or domed upper surface adapted to fit within the user's palm, and a generally planar lower surface.

The outer periphery of the cover is rounded, the term being used to include circular, oval, elliptical, and ovate configurations.

The head includes a plunger that is positioned over the staple discharge slot in the magazine housing lower wall, to push a staple through the slot when the head is moved toward the magazine. The magazine can be slidable positioned within a recess in the lower surface of the head. The plunger can extend downwardly from the upper wall of the recess to engage staples positioned over the discharge slot. If desired, the head can include a separate magazine cap that fits into the head recess and over the magazine housing. This cap can be slidable relative to the magazine, or one end of the cap can be hinged to the rear end of the magazine housing.

Alternatively, the head can pivotally attached to the rear of the magazine, so that the front end of the magazine is compressed into the head recess to force the plunger end against the leading staple. Other attachment means permitting the head to move between uncompressed and compressed positions relative to the magazine will be apparent to one skilled in the art.

The stapler can also be used like a conventional desk stapler for purposes such as stapling together of a plurality of papers by releasibly attaching a pivotal stapler base that includes a stapler anvil. The stapler base is pivotally attached at one end to an end of the stapler cartridge, with the stapler anvil being positioned on the upper surface of the base at the upper end, so that the anvil is beneath the stapler discharge path. The base is designed to be releasable from the rest of the stapler when the stapler is to be used for the earlier described purposes. For example, the stapler cartridge can include a hinge pin with outer protrusions that can be inserted into recesses in the end of the stapler base.

The attachment strap used to hold the upper surface of the stapler head against the user's palm extends from one side of the head, over the top of the head, to the other side of the head. Preferably, the strap is positioned about midway between the ends of the head. The strap can be in the form of an elastic band that has a first end attached to one side of the head, and a second end attached to the opposite side of the head. The band can also be in two overlapping sections, with one section extending from one side of the head, and the other section extending from the other side of the head. The distal ends of the two sections can be held together with a latch, buckle, or hook-and-loop fastener.

In order to position the stapler on a surface, such as a desk, when not in use, the stapler can also include a support base having a upper and lower planar surfaces, and an outer periphery that preferably corresponds to the outer periphery of the stapler head. The upper surface of the support base can include a recess having dimensions corresponding to the outer dimensions of the magazine to receive the portion of the magazine projecting beneath the stapler head.

Since the stapler is designed to fit against a user's palm, the length of the stapler is preferably from about 1.5 to about 3.0 inches, and the stapler width is preferably from about 1.0 to 2.0 inches. The thickness is not critical, but will normally be from about 0.75 to about 1.5 inches when uncompressed. The stapler head, except for any cap insert, and the base, are preferably molded of a suitable plastic, while the remaining parts will normally be of metal. The strap is preferably of a wear-resistant material.

In operation, the user inserts his or her hand through the strap to position the upper surface of the stapler head snugly against the palm. Due to the size of the stapler, the fingers of the user's hand, which are not required to hold the stapler in position, project beyond the outer end of the stapler. Thus, the user is able to use both hands to pick up, position and hold items to be stapled. After an item, such as a piece of paper, is positioned against a surface, the user simply presses the palm of his or her hand, and the stapler supported thereon, against the surface of the item to effect stapling.

When the stapler is to be used as a desktop stapler, the stapler base carrying a stapler anvil is attached. Papers or other items to be stapled can then be inserted between the stapler cartridge and the stapler base, with the stapler head being pressed downwardly to effect stapling.

Thus, it is one aspect of the invention to provide a hand-held stapler supportable in the palm of a user's hand that comprises a stapler head having a staple plunger; a staple magazine carried on the staple head and moveable relative to the staple head between uncompressed and compressed positions; and a strap extending over the stapler head, whereby a hand can be inserted between the strap and the staple head to hold the stapler against the user's palm.

It is another aspect to provide a hand-held stapler supportable in the palm of a user's hand that comprises a stapler head having a longitudinal axis, an egg-shaped periphery with front and rear ends, each end having a given radius of curvature, the front end having a smaller radius of curvature than the radius of curvature of the second end, a domed upper surface and a planar lower surface, the lower surface including a staple magazine recess extending along the longitudinal axis of the head; a magazine cap positioned in the magazine recess; the cap having a cap front end adjacent the head front end, and a cap rear end adjacent the head rear end, the cap including a downwardly extending plunger adjacent the cap front end; a staple magazine carried on the staple head and moveable between uncompressed position and an compressed position in which at least one end of the magazine is inserted into the magazine cap, the magazine including a magazine rear end, and a bottom wall with a staple discharge slot, the slot being positioned beneath the plunger when the staple magazine is in the compressed position; and a strap extending over the stapler head, whereby a hand can be inserted between the strap and the staple head to hold the stapler against the user's palm.

These and other aspects of the invention will become apparent to one skilled in the art after reading the detailed description of the invention that follows, taken with the drawings.

DETAILED DESCRIPTION OF THE INVENTION

Figure 1:
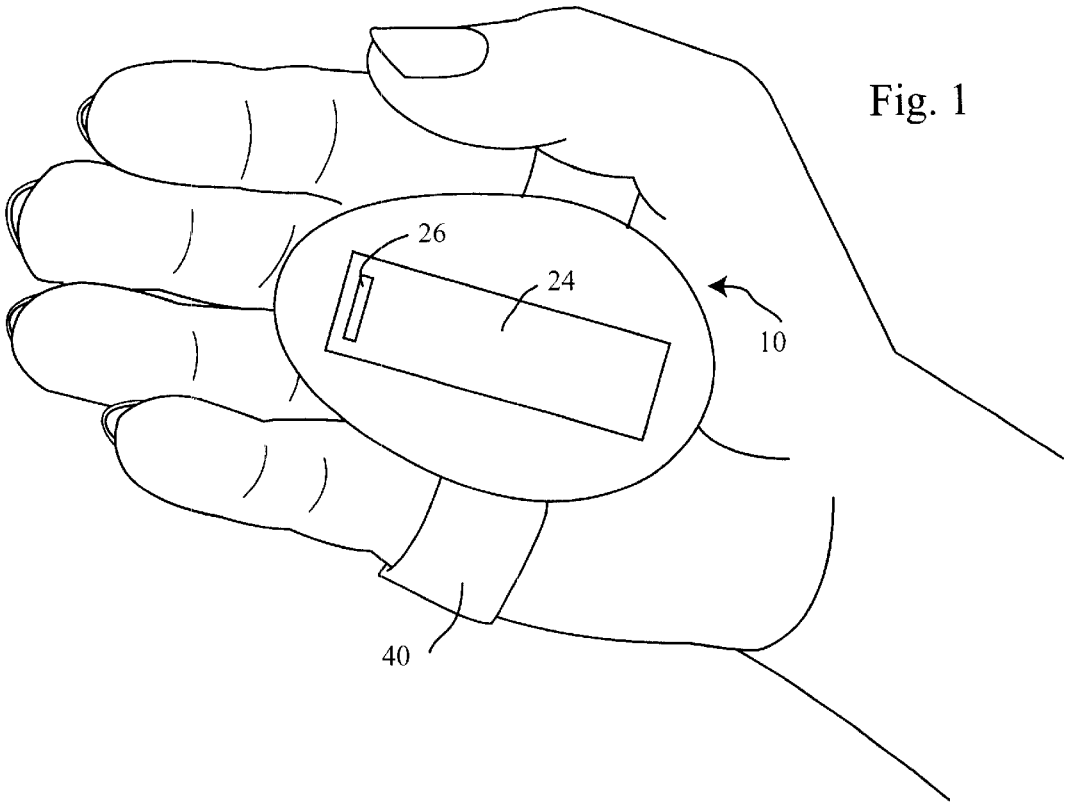
FIG. 1 illustrates the palm stapler held in a user's hand.
Figure 2:
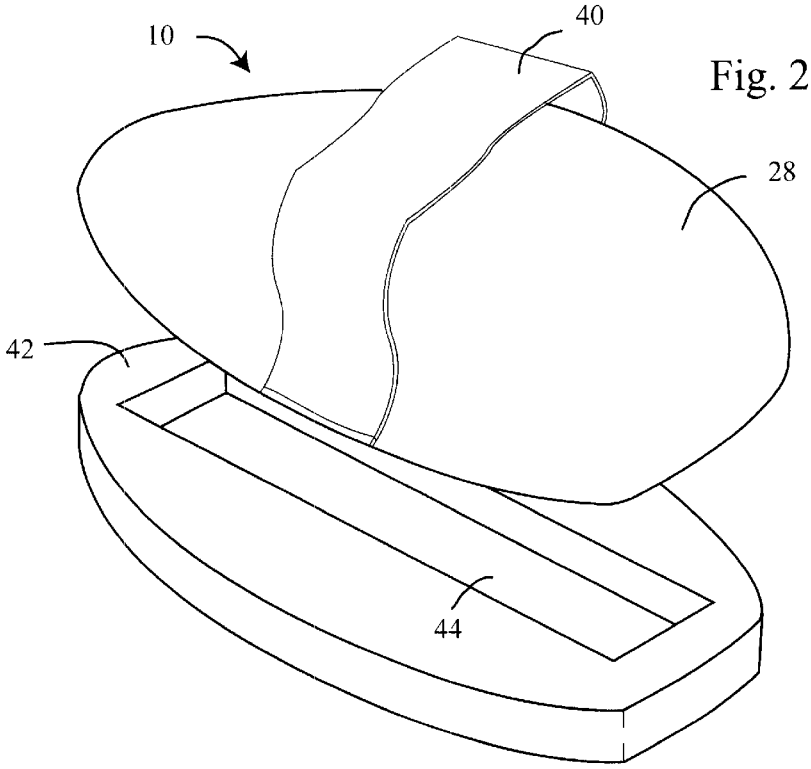
FIG. 2 is a perspective view of the stapler.
Figure 3:
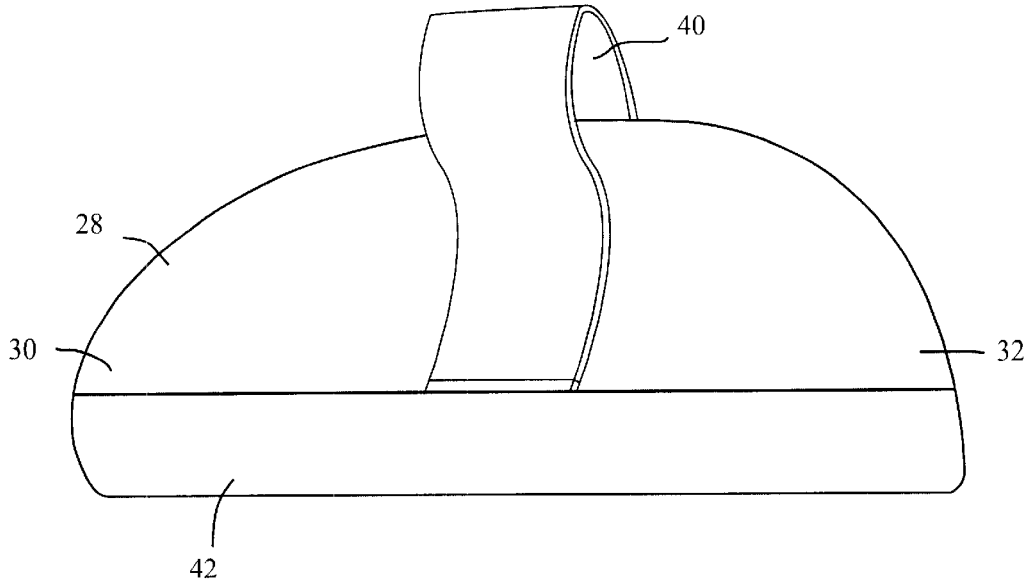
FIG. 3 is side view of the stapler.
Figure 4:
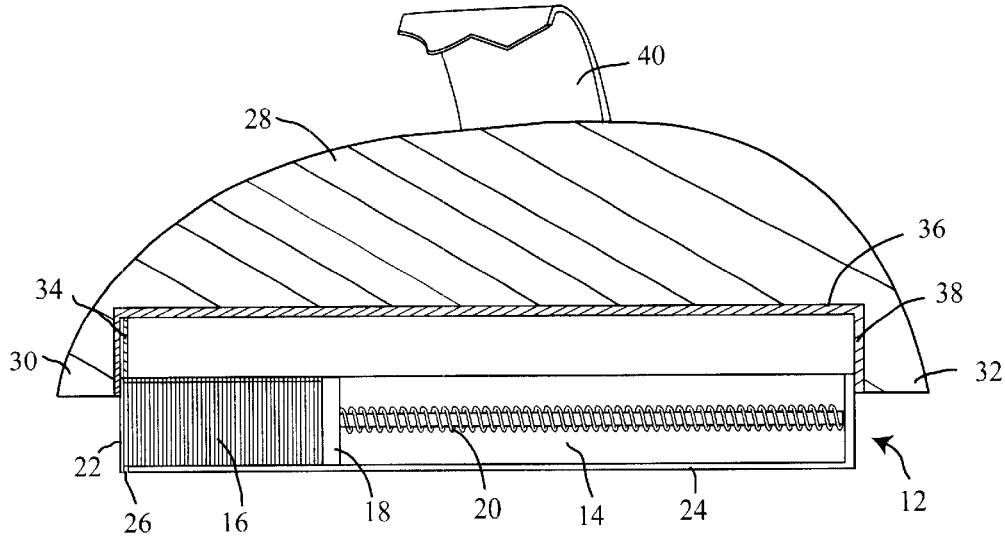
FIG. 4 is a sectional side view of the stapler.
Figure 5:
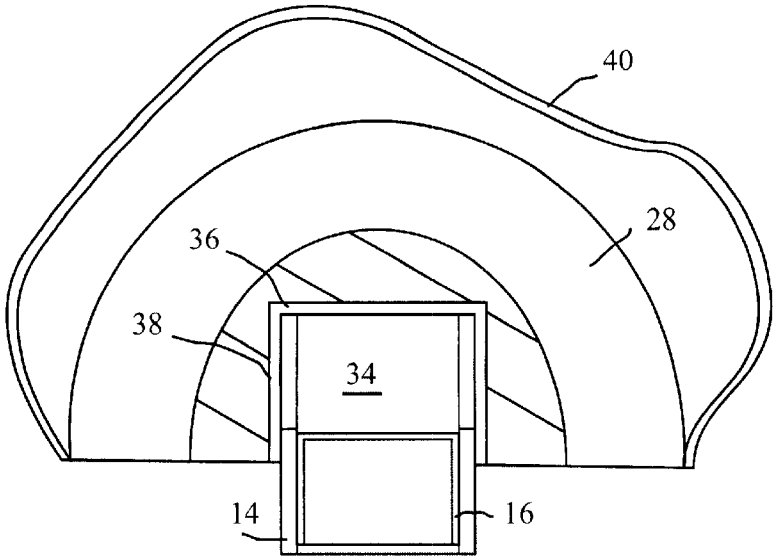
FIG. 5 is sectional end view of the stapler as seen along line 5—5 of FIG. 3.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated, the palm stapler, generally 10, is comprised of a staple magazine, generally 12, that includes staple housing 14 sized to hold a strip of staples 16. A staple positioner block 18 is urged toward the forward end of magazine 12 by spring 20, holding staples 16 against the forward end wall 22 of magazine housing 14. Housing 14 also includes a bottom wall 24 that has a staple discharge slot 26 through which staples are individually discharged.

The staple magazine is moveably positioned on the lower surface of a stapler head 28 that includes a convex or domed upper surface adapted to fit against the user's palm, and a generally planar lower surface. The outer periphery of head 28 is preferably ovate, with the upper surface of the head being shaped like one-half of an egg, which is referred to herein as egg-shaped. Thus, the forward end 30 of the head 28 has a smaller radius of curvature than that of the rear end 32. The forward end of staple housing 14 is preferably adjacent forward end 30 of head 28 to aid the user in accurately positioning a staple.

A plunger 34 extends downward from a magazine recess 36 in head 28 above slot 26 in the bottom wall 24 of housing 14. In the embodiment shown, magazine cap 38, sized to fit over magazine 12, is positioned in recess 36, with plunger 34 extending downward from the upper wall of cap 38.

Figure 6:
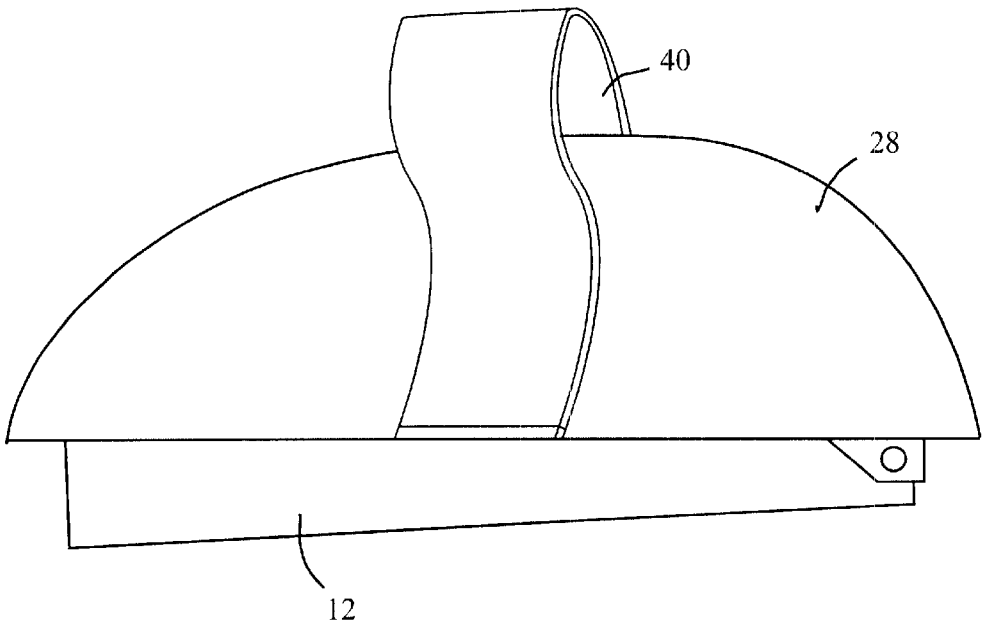
FIG. 6 is a side view of an alternative embodiment of the stapler.

In the embodiment shown in FIGS. 1–5, magazine 12 is slidably positioned within recess 36 in the lower surface of the head 28, whereby magazine 12 moves at least partially into recess 36 when head 28 is pressed downward onto magazine 12. As a result, the lower edge of plunger 34 engages ejects the leading staple through slot 26 and into the item or items to be stapled. Alternatively, as shown in FIG. 6, the rear end of magazine 12 can be pivotally attached to the rear end of magazine cap 38 or another part of head 28, so that the forward end is compressed against plunger 34 when head 28 is pressed downward.

An attachment strap 40 has ends attached to opposite sides of head 28, and extends loosely over the top of head 28, so that a user's hand can be inserted beneath strap 40 to hold stapler in the palm as shown in FIG. 1. Preferably, strap 40 has a width of from about 0.5 to 1.0 inch. Stapler 10, as illustrated, also includes a support base 42 that includes a recess 44 configured to receive the portion of magazine 12 that projects beneath stapler head 28.

Thus, stapler 10 can be used by simply by inserting a hand beneath strap 40 to hold stapler 10 against the palm, leaving the fingers free to grip or position items to be stapled. The user can then use both hands to hold an item, such as a paper, in the desired position, such as against a wall, and then simply press the palm of the hand holding stapler 10 at the desired location to staple the item to the surface.

Figure 7:
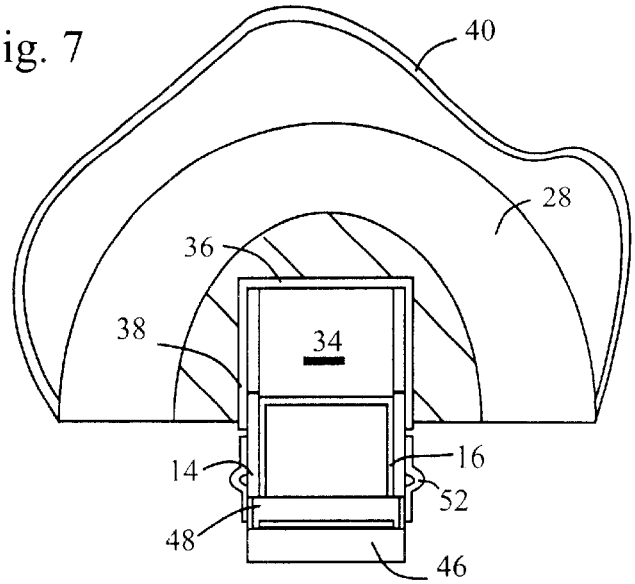
FIG. 7 in a section end view of the stapler of FIG. 6 with a pivotal stapler base attached.
Figure 8:
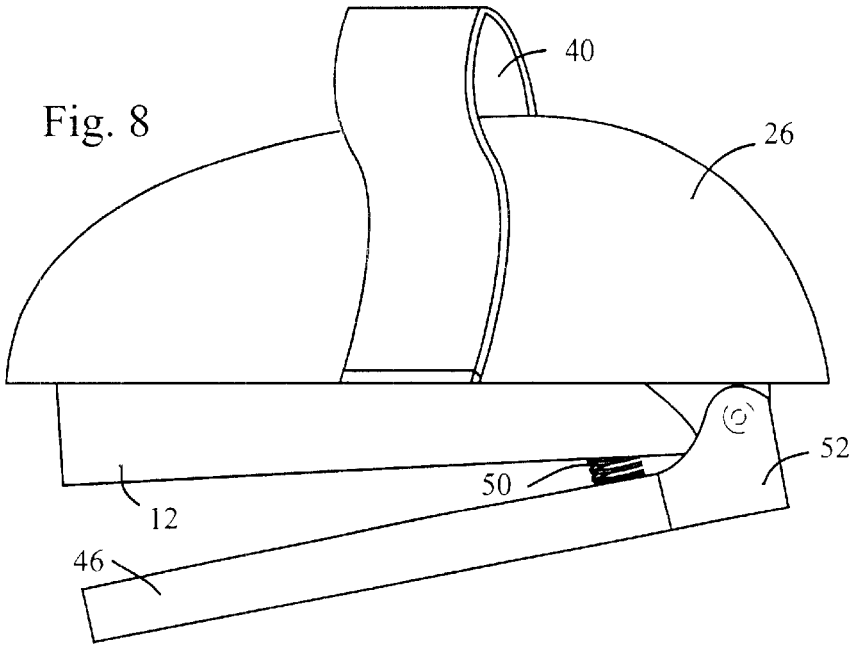
FIG. 8 is a side view of the stapler of FIG. 7.
Figure 9:
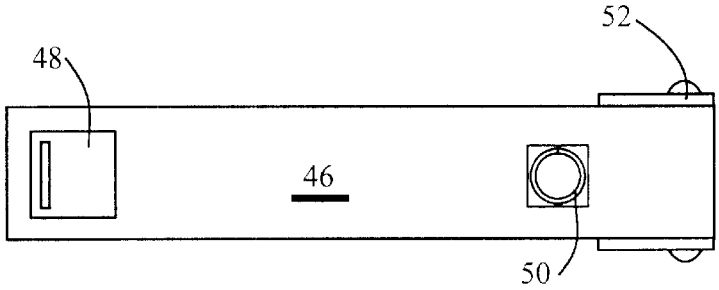
FIG. 9 is a top view of the stapler base attached to the stapler in FIGS. 7 and 8.

As illustrated in FIGS. 7–9, the stapler can also be used as a desktop stapler by releasibly attaching stapler base 46. Base 46 is pivotally attached at one end to magazine 12, and includes stapler anvil 48. Spring 50 urges base 46 away from magazine 12. Upwardly extending side wings 52 slide against the sides to cartridge 12 to releasibly clip base 46 to cartridge 12.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A hand-held stapler supportable on the palm of a user's hand comprising:

a) a stapler head having an upper surface and a downwardly extending staple plunger;

b) a staple magazine carried on said staple head and moveable relative to said staple head between uncompressed and compressed positions; and c) a strap extending over said stapler head, whereby a hand can be inserted between said strap and said staple head to hold said stapler against the user's palm.

2. The stapler of claim 1, wherein said stapler head has a convex upper surface.

3. The stapler of claim 1, wherein said stapler head upper surface has a rounded periphery.

4. The stapler of claim 1, wherein said stapler head upper surface is ovate.

5. The stapler of claim 1, wherein said stapler head upper surface is egg-shaped.

6. The stapler of claim 1, wherein said strap is elastic.

7. The stapler of claim 1, further including a base with an upper surface having a magazine recess.

8. The stapler of claim 1, wherein said stapler head includes a planar lower surface having a staple magazine recess.

9. A hand-held stapler supportable against the palm of a user's hand comprising:

a) a stapler head having a rounded periphery, a domed upper surface and a planar lower surface, said lower surface including a staple magazine recess;

b) a staple magazine carried on said staple head and moveable relative to said staple head between an uncompressed position and a compressed position in which said magazine is inserted into said magazine recess; and c) a strap extending over said stapler head, whereby a hand can be inserted between said strap and said staple head to hold said stapler against the user's palm.

10. The stapler of claim 9, wherein said staple magazine includes an elongated staple housing having a front end and a bottom wall, said bottom wall including a staple discharge slot adjacent said front end and beneath said plunger, and a staple positioner slidable within said housing to position staples over said slot.

11. The stapler of claim 9, further including a stapler magazine cap within said staple magazine recess, said staple magazine being inserted into said cap when said magazine is in the compressed position.

12. The stapler of claim 9, wherein said head has an egg-shaped periphery with a forward end with a first radius of curvature and a rear end with a second radius of curvature, said first radius of curvature being less than said second radius of curvature.

13. The stapler of claim 9, further including a detachable support base, said base having a periphery corresponding to the periphery of said stapler head, and a planar upper surface with a staple magazine recess.

14. The stapler of claim 9, wherein said stapler head has first and second sides, and said strap has first and second ends, the first end of said strap being attached to the first side of said head, and the second end of said strap being attached to the second side of said head.

15. A hand-held stapler supportable against the palm of a user's hand comprising:

a) a stapler head having a longitudinal axis, a rear end with a given radius of curvature, and a front end having a smaller radius of curvature less that said given radius of curvature, a domed upper surface and a planar lower surface, said lower surface including a staple magazine recess extending along the longitudinal axis of said head;

b) a magazine cap positioned in said magazine recess; said cap having a cap front end adjacent said head front end, and a cap rear end adjacent said head rear end, said cap including a downwardly extending plunger adjacent said cap front end;

c) a staple magazine carried on said staple head and moveable between uncompressed position and an compressed position in which at least one end of said magazine is inserted into said magazine cap, said magazine including a magazine rear end, and a bottom wall with a staple discharge slot, said slot being positioned beneath said plunger when said staple magazine is in the compressed position; and d) a strap extending over said stapler head, whereby a hand can be inserted between said strap and said staple head to hold said stapler against the user's palm.

16. The stapler of claim 15, further including a support base having a periphery corresponding to the periphery of said head, said base including a planar upper surface and a magazine recess for insertion of said magazine, whereby the lower surface of said head is supported on the upper surface of said base when said magazine is inserted into said recess.

17. The stapler of claim 15, further including a support base having a first end pivotally attached to said stapler cartridge and a second end including a stapler anvil beneath said staple discharge slot.

18. The stapler of claim 15, wherein said stapler has a length of from about 1.5 to about 3.0 inches, and a width of from about 1.0 to about 2.0 inches.

19. The stapler of claim 15, wherein said strap is elastic.

20. The stapler of claim 15, wherein said magazine rear end is pivotally attached to said cap rear end.

* * * * *